US006106278A

United States Patent [19]

Andersson et al.

[11] Patent Number: 6,106,278

[45] Date of Patent: Aug. 22, 2000

[54] COMBUSTION CHAMBER

[75] Inventors: Leif Andersson, Finspong, Sweden; Peter Jansohn, Küssaberg, Germany; Jonathan Lloyd, Baden, Switzerland

[73] Assignee: ABB Research Ltd., Zurich, Switzerland

[21] Appl. No.: 09/079,396

[22] Filed: May 15, 1998

[30] Foreign Application Priority Data

May 17, 1997 [DE] Germany ..... 197 20 786

[51] Int. Cl.[7] ..... F02C 7/08; F23D 11/44; F23L 13/00; F23L 15/00

[52] U.S. Cl. ..... 431/243; 431/11; 431/353; 431/12; 60/760

[58] Field of Search ..... 431/11, 8, 350, 431/351, 352, 353, 243, 158, 12; 60/751, 755, 756, 752, 758, 759, 760, 746, 747, 736

[56] References Cited

U.S. PATENT DOCUMENTS

| | | | |
|---|---|---|---|
| 3,333,414 | 8/1967 | Saintsbury | 60/756 |
| 3,352,106 | 11/1967 | Pianko | 60/755 |
| 3,451,216 | 6/1969 | Harding . | |
| 3,669,628 | 6/1972 | Latham, Jr. et al. | 431/351 |
| 3,899,876 | 8/1975 | Williamson | 431/352 |
| 4,064,300 | 12/1977 | Bhangu | 431/352 |
| 4,651,534 | 3/1987 | Stroem . | |

FOREIGN PATENT DOCUMENTS

| | | | |
|---|---|---|---|
| 0203431 | 12/1986 | European Pat. Off. . | |
| 0704657A2 | 4/1996 | European Pat. Off. . | |
| 2728399C2 | 1/1979 | Germany . | |
| 3100849A1 | 12/1981 | Germany . | |
| 3721143A1 | 1/1989 | Germany . | |
| 4232442A1 | 3/1994 | Germany . | |
| 4239856A1 | 6/1994 | Germany . | |
| 19516798A1 | 11/1996 | Germany . | |
| 19523094A1 | 1/1997 | Germany . | |
| 0072822 | 4/1983 | Japan | 60/747 |
| 403186116 | 8/1991 | Japan | 431/350 |
| 1315856 | 5/1973 | United Kingdom . | |
| 1571213 | 7/1980 | United Kingdom . | |

*Primary Examiner*—Carl D Price
*Attorney, Agent, or Firm*—Burns, Doane, Swecker & Mathis, L.L.P.

[57] ABSTRACT

The object of the invention is to provide a novel combustion chamber which has an improved air supply and also ensures an optimum incident flow to the burners when the mass flows of cooling and combustion air are different. According to the invention, this is achieved in that the at least one cooling duct (10) is extended right into the plenum (13) and is formed inside the plenum (13) as a diffuser (14) having an orifice (12) leading into the plenum (13). The at least one opening (15, 15') in the burner dome (4) is arranged in the region of the diffuser (14) or directly downstream of its orifice (12). A bypass duct (16, 16') having an orifice (17, 17') leading into the plenum (13) follows downstream of each opening (15, 15'). The orifice (17, 17') of each bypass duct (16, 16') is oriented at least approximately in parallel with the orifice (12) of the diffuser (14) and is also designed so as to be offset step-like to the outside. Each bypass duct (16, 16') is provided with a pressure-regulating device (18, 18').

11 Claims, 2 Drawing Sheets

COMBUSTION CHAMBER

BACKGROUND OF THE INVENTION

1. Field of the Invention

The invention relates to a combustion chamber which has an improved air supply.

2. Discussion of Background

The combustion chambers of gas-turbine plants are supplied with liquid and/or gaseous fuel and atomization air via a number of burners. To this end, the burners are often arranged in a burner dome which closes off the space around the burners, the so-called plenum, to the outside. The plenum is arranged upstream of the combustion chamber and connected to the combustion-chamber wall. The air required for the combustion is delivered by the compressor of the gas-turbine plant. In the process, the main air flow is first of all used to cool the combustion-chamber wall and to this end is directed in cooling ducts on the outside on the combustion-chamber wall. The cooling ducts lead into the plenum. From there, the air preheated in the cooling ducts passes as combustion air via the burners into the combustion chamber and is finally burned together with the fuel used. In order to be able to ensure reliable burner operation, a defined flow structure must be imposed on the combustion air entering the burner dome.

With the use of newer combustion-chamber cooling techniques, the requisite cooling-air and combustion-air quantities differ markedly from one another in part. Since very large air quantities are desired for the combustion, an appropriate air quantity of the compressor air flow, in addition to the cooling air, is passed directly into the burner dome. So that this so-called bypass air can likewise be introduced into the plenum, suitable openings are formed in the burner dome, as shown, for example, by DE 195 16 798 A1.

A further solution for the addition of bypass air is disclosed by DE 195 23 094 A1, in which solution this secondary air flow is introduced into the main air flow (cooling air) via at least one injector system located at the transition to the plenum. Given good mixing of both air flows, a small pressure loss can thereby be realized.

In accordance with the thermal design of the gas turbine and the fuel used, however, the air requirement for the combustion in the combustion chamber and for the cooling of the combustion chamber may vary considerably. It is therefore necessary for the bypass air quantity to be variable. Despite a changed mass flow of the bypass air, however, the flow conditions in the burner dome must not be disturbed. Otherwise, i.e. under unfavorable inflow conditions of the bypass air, vortices, backflow zones and other phenomena of this type, which may have an adverse effect on the main air flow and its stability, are produced.

SUMMARY OF THE INVENTION

Accordingly, one object of the invention, in attempting to avoid all of these disadvantages, is to provide a novel combustion chamber which has an improved air supply and also ensures an optimum incident flow to the burners when the mass flows of cooling and combustion air are different.

According to the invention, this is achieved in that, in a device according to the preamble of claim 1, the at least one cooling duct is extended right into the plenum and is formed there as a diffuser having an orifice leading into the plenum. The at least one opening in the burner dome is arranged in the region of the diffuser or directly downstream of its orifice. A separate bypass duct having an orifice leading into the plenum follows downstream of each opening in the burner dome. The orifice of each bypass duct is designed so as to be offset step-like to the outside relative to the orifice of the diffuser and is oriented at least approximately in parallel with the latter. Each bypass duct is provided with a pressure-regulating device for the bypass air.

By means of this geometry, not only the mass flow but also the velocity and the flow orientation of the bypass air can be adapted to the main air flow, i.e. to the combustion air flowing into the plenum via the at least one cooling duct. In this case, the bypass air is directed into the plenum not only parallel to the main air flow but also as a so-called wall jet directly on the inner wall of the burner dome. Flow separations can therefore be effectively countered. The pressure-regulating devices attached to the bypass ducts advantageously lead to an adaptation of the pressure ratios of the secondary air flow (bypass air) to the pressure ratios prevailing in the main air flow. In this way, disturbances of the incident flow to the burners can be avoided, which leads to improved combustion in the combustion chamber and thus to low-emission, effective operation of the gas-turbine plant. In addition, the diffuser provides for a reduction in the flow velocity and for maximum pressure recovery of the main air flow. If no bypass air is required, the orifices of the bypass ducts act as steps and form a so-called step diffuser, at the end of which a defined separation point is produced. This risk of an undefined, i.e. non-localized, separation in the diffuser is thus avoided.

In an especially advantageous manner, at least one further opening is formed in the burner dome downstream of each opening. In a similar manner to the openings arranged upstream, each further opening has a bypass duct arranged downstream and having an orifice leading into the plenum. Each of these bypass ducts likewise has a pressure-regulating device. It is therefore possible to adapt the height of each individual bypass duct to an optimum diffuser operation. The orifices of the bypass ducts of the openings arranged one behind the other in the direction of the main air flow are offset step-like and are arranged at least approximately parallel to one another. This double step leads to the required orientation of the bypass air. Since the separation zones in the trail of smaller steps are correspondingly smaller, a plurality of small steps result in a smaller pressure loss than a single large step.

It is especially expedient if the pressure-regulating devices are designed as honeycombs and are arranged on the air inlet side in the slots. The bypass air is oriented and evened out by means of the honeycomb body, so that a defined incident flow to the plenum can be achieved. By virtue of the fact that the type of honeycomb, i.e. its length and blocking action, is selected in accordance with the requisite pressure loss, the secondary air flow can be adapted to the velocity and pressure ratios of the main air flow which are to be expected in accordance with the general operating conditions of the combustion chamber. It is possible to exchange the honeycombs during inspection time and downtime, so that these pressure-regulating devices can also be adapted to changed operating conditions. A holder for a honeycomb cover is attached at least to the honeycomb arranged furthest downstream. Due to the fitting of the honeycomb cover, which likewise takes place when the machine is shut down, the honeycomb can be closed and thus the machine can also react advantageously to a greater requirement for cooling air.

As an alternative to the honeycombs, the pressure-regulating device consists of a barrier plate, which closes the opening and has at least one impact hole passing through it, and of an impingement surface arranged in the interior of the bypass duct. During operation of the combustion chamber, the jets of the secondary air flow, which penetrate through the impact holes into the plenum, first of all strike the impingement surfaces, as a result of which the desired pressure loss is achieved.

In an especially advantageous manner, at least one of the impact holes is designed in such a way that it can be closed and to this end is provided with a holder for a hole cover. The fitting or removal of the hole cover is likewise effected when the machine is shut down. With appropriately blocked or opened impact holes, the inflowing mass of bypass air can be adapted to the cooling requirement of the combustion chamber. To this end, it is expedient if in each case that impact hole of each barrier plate which is arranged furthest downstream can be closed, so that the best possible diffuser action for the main air flow is ensured.

Finally, at least two openings are formed in the burner dome and are distributed uniformly in a plane lying at least approximately transversely to the compressor air flow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of the combustion chamber of a gas-turbine plant, wherein.

Figure 1:
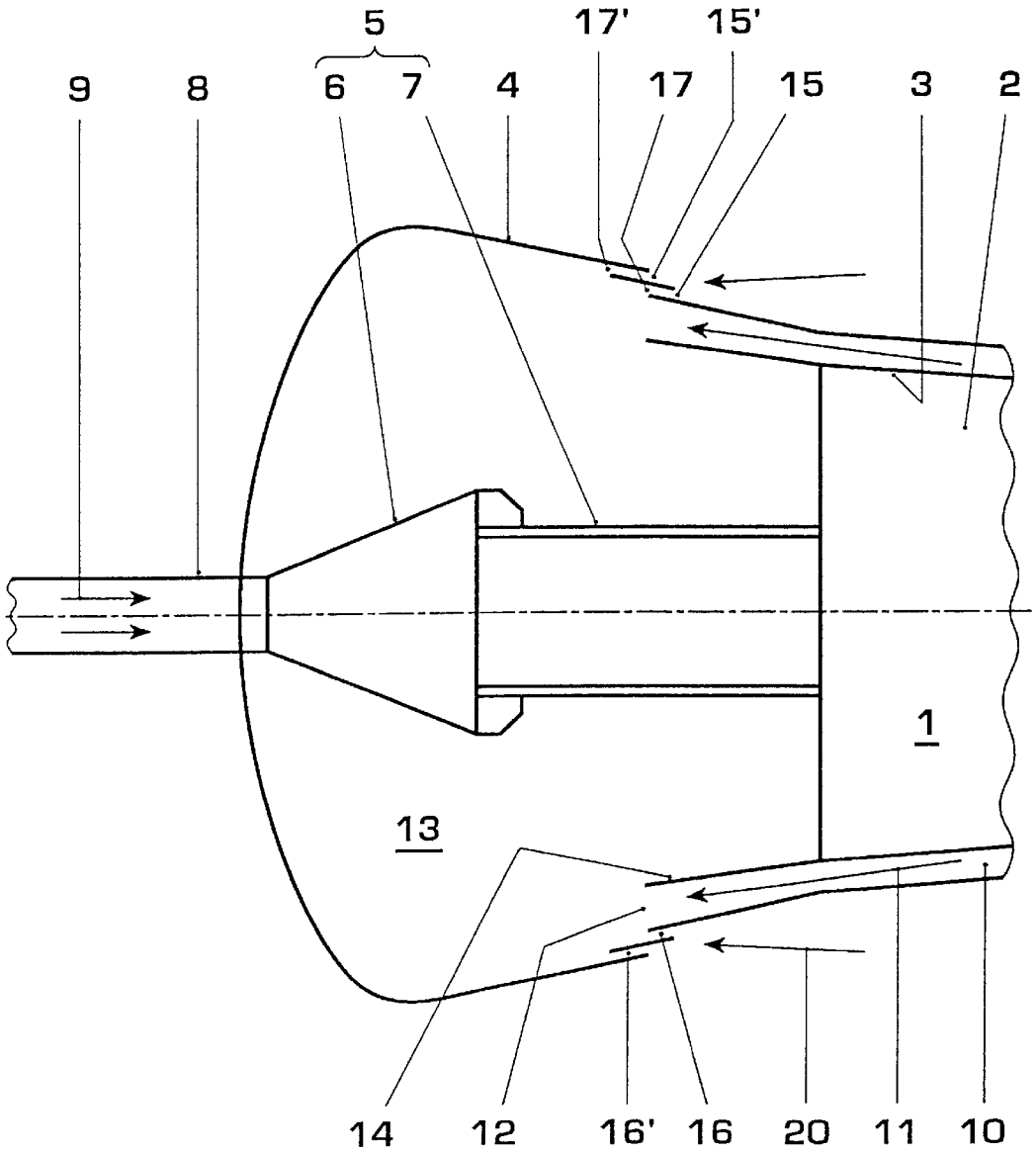
FIG. 1 shows a partial longitudinal section of the combustion chamber.

Only the elements essential for the understanding of the invention are shown. Elements of the gas-turbine plant which are not shown are, for example, the compressor and the gas turbine as well as the fuel feeds lying outside the burner dome. The direction of flow of the working media is designated by arrows.

DESCRIPTION OF THE PREFERRED EMBODIMENTS

Referring now to the drawings, wherein like reference numerals designate identical or corresponding parts throughout the several views, the gas-turbine plant (not shown) mainly comprises a compressor, a combustion chamber 1 designed as an annular combustion chamber and having a combustion space 2 and a combustion-chamber wall 3, a gas turbine, and a generator attached to the latter. Connected to the combustion space 2 of the annular combustion chamber 1 are numerous burners 5, which are fastened in a burner dome 4, serve to feed the fuel and are designed as cone burners. On the incident-flow side, each cone burner 5 consists of a swirl generator 6 and a mixing section 7, which follows with a smooth transition and leads into the combustion space 2. The cone burners 5 disclosed by EP 07 04 657 A2 and designed accordingly are also designated as tubular burners on account of their tubular mixing section 7. They are supplied with fuel 9 from outside the burner dome 4 via in each case a burner lance 8 (only shown schematically). Other burners may of course also be used.

Arranged outside and encasing the combustion space 2 are cooling ducts 10, into which combustion air required for the combustion of the fuel 9 in the annular combustion chamber 1 is fed from the compressor. The combustion air, which is first of all utilized to cool the combustion-chamber wall 3, forms a uniform main air flow 11, which is directed via orifices 12 of the cooling ducts 10 into a space 13, the so-called plenum of the cone burners 5, which is formed inside the burner dome 4. To this end, the cooling ducts 10 are extended right into the plenum 13 and are formed inside the plenum 13 as diffusers 14, so that the orifices 12 of the cooling ducts 10 coincide with those of the diffusers 14. At the level of the upstream end of the respective diffuser 14, in each case two openings 15, 15' designed as slots are arranged in the burner dome 4 on either side of the latter (FIG. 1). Following downstream of each of the slots 15, 15' is a bypass duct 16, 16' having an orifice 17, 17 leading into the plenum 13. The orifices 17, 17' of the bypass ducts 16, 16' are oriented approximately parallel to the orifices 12 of the diffusers 14. In addition, the orifices 17, 17' of the bypass ducts 16, 16' are offset step-like to the outside relative to one another and to the orifices 12 of the diffusers 14.

Figure 2:
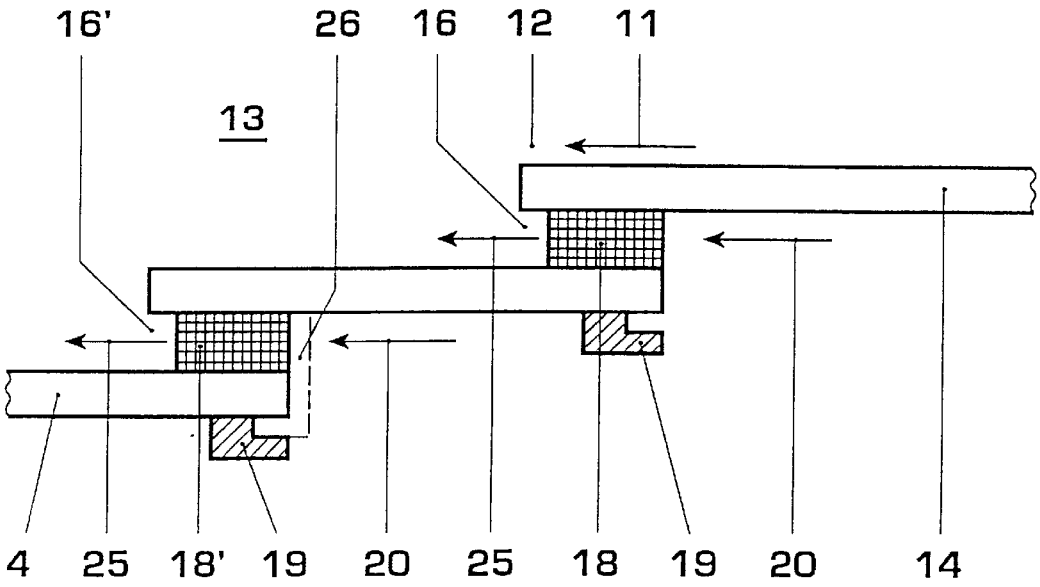
FIG. 2 shows an enlarged representation of the burner dome in the region of the slots.

In a first exemplary embodiment of the invention, pressure-regulating devices 18, 18' designed as honeycombs are arranged on the air-inlet side in the bypass ducts 16, 16'. On either side of the burner dome 4, the honeycombs 18, 18' are each provided with a holder 19 for a honeycomb cover 26 (shown by broken line) and are thus designed in such a way that they can be closed (FIG. 2).

During operation of the annular combustion chamber 1, different outputs are demanded in accordance with the combustion-chamber cooling concept, so that some of the combustion air required in the annular combustion chamber 1 has to be made available to a varying extent for the cooling of the combustion-chamber wall 3. To this end, a secondary air flow 20 is branched off from the combustion air fed from the compressor and is directed as bypass air into the plenum 13 via the slots 15, 15' arranged in the burner dome 4 (FIG. 1). The quantity of this bypass air 20 may be up to 20% of the total combustion-air quantity. In the process, the bypass air 20 is introduced into the plenum 13 in so-called wall jets 25 largely parallel to the main air flow 11 and with approximately the same velocity as the main air flow 11 (FIG. 2). The requisite pressure loss of the bypass air 20 is realized via the honeycombs 18, 18'. In this way, disturbances in the incident flow to the burners are avoided, which leads to improved combustion in the annular combustion chamber 1 and thus to a low-emission, effective operation of the gas-turbine plant.

In addition, since the main air flow 11 is introduced into the plenum 13 through the diffusers 14, its pressure loss can be reduced. Thus the pressure difference between the main air flow 11 and the secondary air flow 20 is reduced, so that the use of shorter honeycombs 18, 18' becomes possible. The mass flow of the bypass air 20 can be subsequently adapted to the measured requirement of the annular combustion chamber 1 by means of the honeycomb covers 26. To this end, when the gas-turbine plant is shut down, the honeycomb cover 26 is inserted into the corresponding holder 19 and fastened there, the honeycomb 18' arranged furthest downstream being closed first. The honeycomb covers 26 may of course also be welded on.

Finally, both the main air flow 11, which is preheated by convective cooling of the combustion chamber wall 3, and the secondary air flow 20 of the combustion air pass via the plenum 13 into the cone burners 5 and from there into the annular combustion chamber 1. In the annular combustion chamber 1, the combustion air, together with the fuel 9 used, is burned to form a hot working gas. The working gas is expanded across the gas turbine (not shown), and serves to drive both the compressor and the generator, which in turn generates current for external consumers.

In a second exemplary embodiment of the invention, the pressure-regulating devices 18, 18' are each designed as a combination of two rows of impact holes 22, 22', which are arranged in a barrier plate 21, 21' closing the slots 15, 15', with for each slot 15, 15' an impingement surface 23, 23' arranged in the interior of the bypass duct 16, 16'. The impact holes 22, 22' are distributed over the entire pheriphery of the barrier plate 21, 21'. The slot 15 arranged upstream on one side of the burner dome 4 has a first impingement surface 23, and the slot 15' arranged downstream on the same side of the burner dome 4 has a second impingement surface 23'. Both impingement surface 23, 23' as well as the burner dome 4, which is arranged downstream, are designed to be stepped in the direction of the main air flow 11. On either side of the burner dome 4, the impact holes 22, 22' are designed in such a way that they can be closed and to this end are provided with a holder 24 for a hole cover 27 (shown by broken line).

During operation of the annular combustion chamber 1, the jets of the bypass air 20, which penetrate through the impact holes 22, 22' and the adjoining bypass ducts 16, 16' into the plenum 13, first of all strike the impingement surfaces 23, 23', as a result of which the desired pressure loss is achieved. Depending on the mode of operation, one or more rows of impact holes may be closed, the rows of impact holes arranged downstream being closed first. The rest of the adaptation of the secondary air flow 20 to the main air flow 11 is effected in a manner analogous to the first exemplary embodiment.

Figure 3:
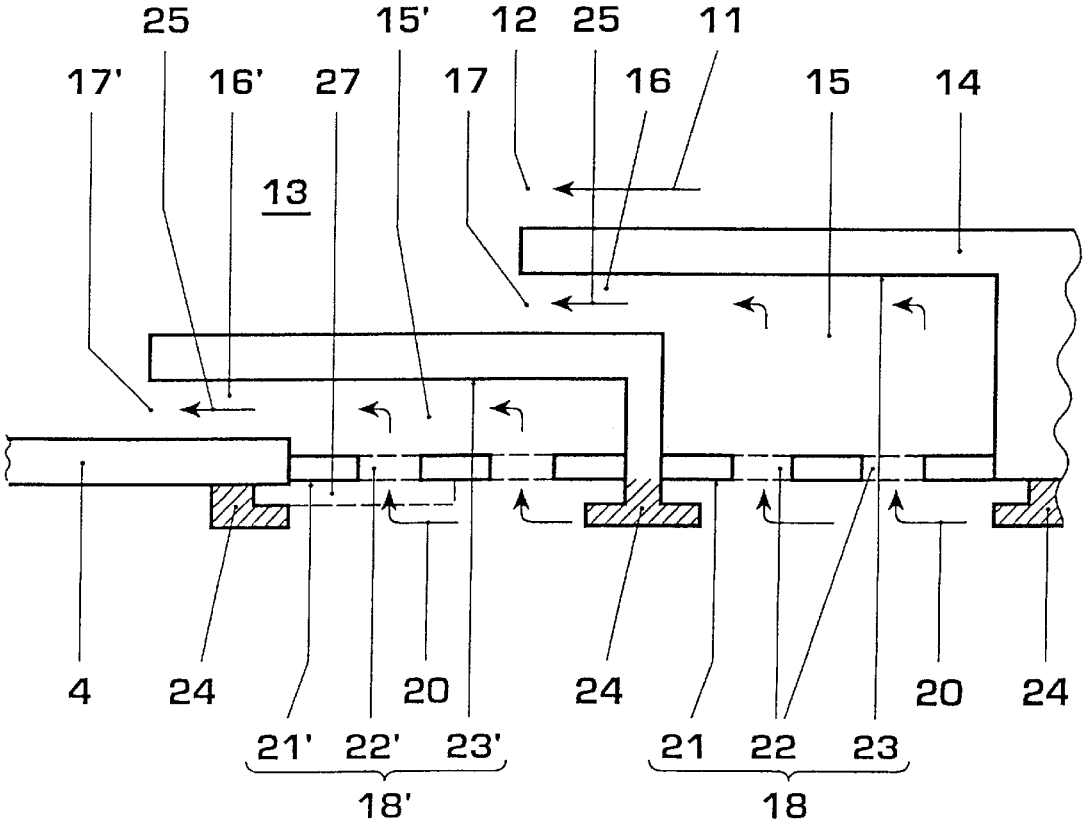
FIG. 3 shows a representation according to FIG. 2 but in a second exemplary embodiment.

In both exemplary embodiments, the outer slot 15' of the so-called double step may be blocked (FIG. 2, only partly shown in FIG. 3). In this case, the inner slot 15 maintains the secondary air flow 20 to the required extent, while the outer slot 15' acts as a stepped diffuser. If no bypass air 20 is required, both slots 15, 15' can also be closed, as a result of which a two-step diffuser is obtained (not shown). With such a diffuser, a larger pressure gain can be obtained than with a single large step. An appropriate separation section between the two slots 15, 15' ensures that a backflow into the diffuser 14 does not occur.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letter Patent of the United States is:

1. A combustion chamber having a plenum which is defined to an outside by a burner dome, the plenum intended for receiving at least one main air flow having a first air flow direction, having at least one burner arranged in the plenum, a combustion space formed downstream of the plenum in the first air flow direction, at least one cooling air duct leading into the plenum and encasing the combustion chamber, and having at least one opening formed in the burner dome and intended for a secondary air flow, the secondary air flow having a second air flow direction, wherein (a) the at least one cooling air duct is extended right into the plenum and is formed inside the plenum as a diffuser, the at least one cooling air duct having an orifice leading into the plenum, (b) the at least one orifice opening in the burner dome is arranged in the region of the diffuser, (c) a bypass duct having an orifice leading into the plenum is arranged downstream of each opening in the first air flow direction, (d) the orifice of each bypass duct is oriented at least approximately in parallel with the orifice of the diffuser and is also designed so as to be offset step-like to the outside, (c) each bypass duct is provided with a pressure-regulating device.

2. The combustion chamber as claimed in claim 1, wherein at least one further opening is formed in the burner dome downstream of each opening in the second air flow direction, each further opening has a bypass duct arranged downstream in the second air flow direction and having an orifice leading into the plenum, each bypass duct has a pressure-regulating device, and the orifices of the bypass ducts are offset step-like and are arranged at least approximately parallel to one another.

3. The combustion chamber as claimed in claim 1, wherein the pressure-regulating devices are designed as honeycombs.

4. The combustion chamber as claimed in claim 3, wherein the honeycombs are arranged on the air inlet side in the bypass ducts.

5. The combustion chamber of claim 3, wherein at least one of the honeycombs is designed in such a way that it can be closed.

6. The combustion chamber of claim 5, wherein at least the honeycomb arranged furthest downstream in the second air flow direction is provided with a holder for a honeycomb cover.

7. The combustion chamber as claimed in claim 1, wherein each pressure-regulating device consists of a barrier plate, which closes the opening and has at least one impact hole passing through the barrier plate, and of an impingement surface arranged in the interior of the bypass duct.

8. The combustion chamber as claimed in claim 7, wherein at least one of the impact holes of each pressure-regulating device is designed in such a way that the impact holes may be closed.

9. The combustion chamber as claimed in claim 8, wherein the impact holes of each barrier plate which is arranged furthest downstream in the second air flow direction is provided with a holder for a hole cover and a hole cover.

10. The combustion chamber as claimed in claim 1, wherein at least two openings are in each case formed in the burner dome and are distributed uniformly in a plane lying at least approximately transversely to the main air flow.

11. The combustion chamber of claim 1, wherein the at least one orifice opening in the burner dome is arranged directly downstream of its orifice in the first air flow direction.

* * * * *